US007210258B2

(12) United States Patent
Lanti

(10) Patent No.: US 7,210,258 B2
(45) Date of Patent: May 1, 2007

(54) OBJECT FOR ORNAMENTAL PURPOSES

(75) Inventor: Andrea Lanti, Vicenza (IT)

(73) Assignee: Nova Rank Export S.R.L., Torri Di Quartesolo (Vicenza) (IT)

( * ) Notice: Subject to any disclaimer, the term of this patent is extended or adjusted under 35 U.S.C. 154(b) by 68 days.

(21) Appl. No.: 11/071,625

(22) Filed: Mar. 3, 2005

(65) Prior Publication Data

US 2006/0059737 A1 Mar. 23, 2006

(30) Foreign Application Priority Data

Jun. 15, 2004 (IT) ..... VI2004A0147

(51) Int. Cl.
*G09F 7/02* (2006.01)

(52) U.S. Cl. ..... 40/618; 63/40

(58) Field of Classification Search ..... 40/618; 63/40

See application file for complete search history.

(56) References Cited

U.S. PATENT DOCUMENTS 2,696,689 A * 12/1954 Speck et al. ..... 40/618
4,884,351 A * 12/1989 Abramson ..... 40/611.05
5,896,757 A 4/1999 Kharloubian

* cited by examiner

*Primary Examiner*—Cassandra Davis
(74) *Attorney, Agent, or Firm*—Bucknam and Archer

(57) ABSTRACT

There is described an object for ornamental purposes of the type that has at least one channel 1 where at least one decorative element 2 is arranged that engages, with its side appendices, at tracks 3 formed on the side edges of the channel, which allows the sliding of the decorative element along the channel itself. The object for ornamental purposes includes elements that allow the user to remove the sliding element(s) from the channel(s) in which it or they are arranged so as to allow the replacement of the element(s) with other sliding element(s) into the channel(s), in order to modify the overall aesthetic appearance of the object.

2 Claims, 2 Drawing Sheets

OBJECT FOR ORNAMENTAL PURPOSES

BACKGROUND OF THE INVENTION

The present invention relates to an object for ornamental purposes or, more particularly, to an article of jewelry.

For some time objects for ornamental purposes have been known that have one or more channels where one or more decorative elements are arranged that engage, with two of their side appendices, at tracks or slits formed on the side edges of the channel. This permits the sliding of the element or elements along the channel, which allows the modification of the overall configuration of the object for ornamental purposes. An example of such an object for ornamental purposes is described in U.S. Pat. No. 5,896,757, to Kharloubian, granted Apr. 27, 1999.

However, in these prior art embodiments the decorative elements are inserted in the channel at the manufacturing stage of the object and it is impossible for the user to withdraw them from the channel, or to insert others in the same channel.

SUMMARY OF THE INVENTION

The object of the present invention is to provide an object for ornamental purposes of the type described which allows the user to modify the overall aesthetic appearance of the object for ornamental purposes.

This object is accomplished, according to the present invention, by providing means that allow the user to take out the sliding elements from the channels in which they are arranged, in order to allow the replacement of said elements with other sliding elements, or the integration of additional sliding elements inside the channels in question.

BRIEF DESCRIPTION OF THE DRAWINGS

The invention will now be described in detail, with reference to some embodiments thereof, given as non-limiting examples with the help of the accompanying drawings, in which.

DETAILED DESCRIPTION OF THE INVENTION

In FIGS. 1 to 5 it can be seen that the object for ornamental purposes according to the invention has a channel 1, where two decorative elements 2 can slide, which engage, with their side appendices 2', at slits or tracks 3 (see FIG. 5) formed on the side edges of the channel. With such a constructive arrangement the decorative elements 2 can slide along the channel, during normal use of the object for ornamental purposes.

Figure 1:
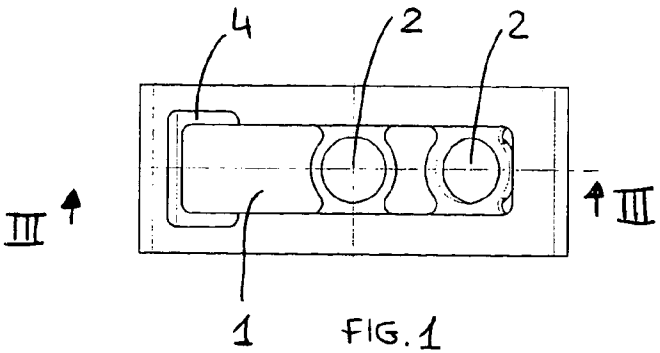
FIG. 1 is a front view of a first embodiment of the object for ornamental purposes according to the present invention.
Figure 3:
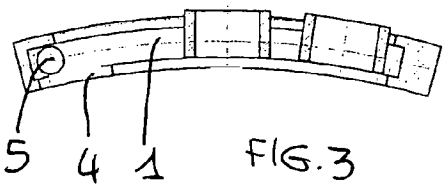
FIG. 3 is a longitudinal cross-sectional view of the object shown in FIG. 1 taken along line III—III of FIG. 1.
Figure 2:
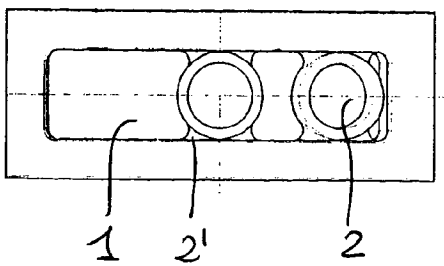
FIG. 2 is a rear view of the object for ornamental purposes shown in FIG. 1.
Figure 5:
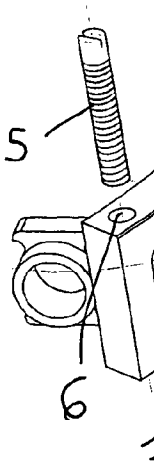
FIGS. 4 and 5 are two axonometric views of the object for ornamental purposes according to the invention, shown at the opposite faces thereof.
Figure 4:
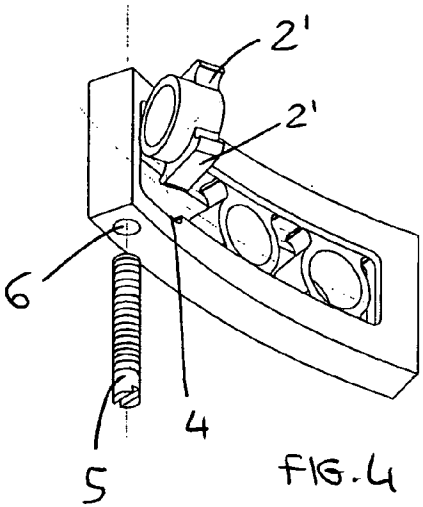
Figure 6:
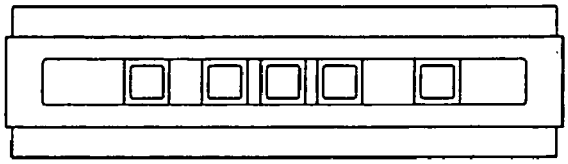
FIGS. 6 to 14 show several different embodiments of the object for ornamental purposes according to the present invention.
Figure 7:
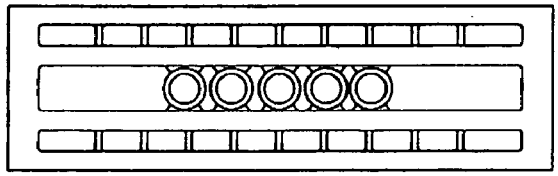
Figure 8:
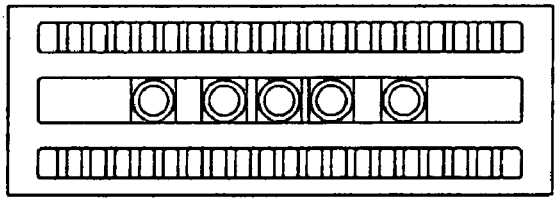
Figure 9:
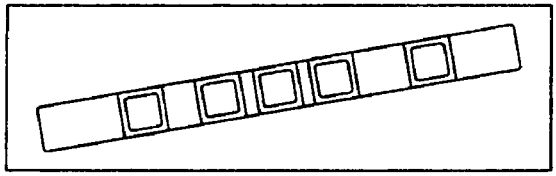
Figure 10:
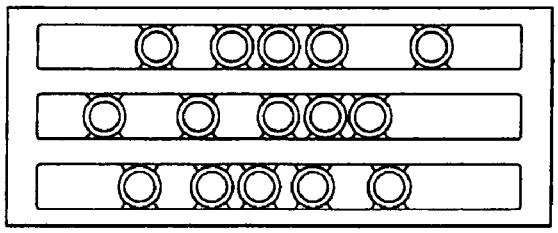

A fundamental characteristic of the device according to the invention consists of the fact that, as can be seen in FIGS. 1, 3 and 4, the channel 1 has a widening 4, on one of the side faces of the object, at one end of the channel. The presence of this widening ensures that the decorative elements 2 can be removed from the channel or inserted back in again, all as can clearly be seen in FIGS. 4 and 5.

In order to allow the insertion of the decorative elements 2 inside the channel 1, a pin 5 is arranged transversally in the channel, the presence of which inside the channel blocks it and therefore prevents the various decorative elements from being removed from the channel or prevents the insertion of other decorative elements into it. This pin, which advantageously is threaded, can be inserted into or withdrawn from its seat 6 directly by the user, who can thus decide for himself what and how many elements to insert inside the channel, according to his particular tastes regarding the aesthetic characterization of the device according to the invention.

Figure 11:
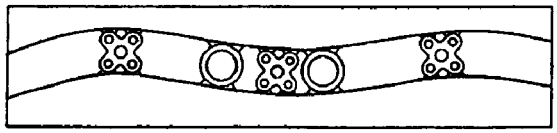
Figure 12:
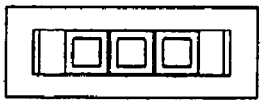
Figure 13:
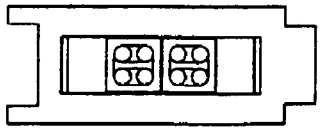
Figure 14:
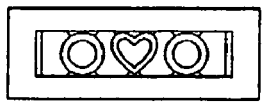

As can be seen in FIGS. 6 to 14, the object for ornamental purposes according to the present invention can have one or more channels, the channels can be arranged with an inclined direction with respect to the longitudinal direction of the object, and finally the channels can also have a curvilinear progression as illustrated in FIG. 11. Moreover, different shaped elements can be arranged in the same channel.

As a non-limiting example, the object for ornamental purposes can be used to make bracelets, necklaces, earrings, brooches and jewelry in general, watches, watch-holders and relative cases.

The embodiments illustrated and described herein are given only as non-limiting examples. In particular, the channels can take up very different geometric arrangements to those mentioned above, limited only by one's inspiration and creativity. For example, said channels can be in the shape of a cross, circular, heart-shaped, as well as take the form of letters of the alphabet and numbers.

From the above it can thus be seen that through the device according to the present invention, the user certainly has the possibility of easily and simply modifying the configuration of the object for ornamental purposes, this being obtained thanks to the modification of the number and quality of the sliding elements arranged in the channels present in the object itself.

What is claimed is:

1. An object for ornamental purposes, said object comprising:

a) a channel (1) having tracks (3) formed at side edges of said channel (1);

(b) at least one decorative element (2) having side appendices (2') adapted to slidably engage the tracks (3) of said channel (1) whereby said at least one decorative element (2) is adapted to slide along said channel (1);

(c) a widening (4) formed at an end of said channel (1) at a face thereof whereby said at least one decorative element (2) can be removed from and inserted into said channel (1); and (d) a removable pin (5) threadably engaged in a seat (6) is arranged transversely in said channel (1) at said widening (4) so as to prevent the removal of said at least one decorative element (2) from said channel (1), whereby the removal of said removable pin (5) from said channel (1) permits the removal of said at least one decorative element (2) from said channel (1).

2. The object for ornamental purposes are defined in claim 1, which comprises a plurality of channels (1) in each of which at least one decorative element (2) is arranged.

* * * * *